US006138643A

United States Patent [19]

Oguchi et al.

[11] Patent Number: 6,138,643

[45] Date of Patent: Oct. 31, 2000

[54] FUEL INJECTION DEVICE WITH OIL SEAL

[75] Inventors: Tetsuro Oguchi, Oyama; Hisao Naoi, Tochigi; Takumi Ito, Oyama; Tadashi Iijima, Yuuki, all of Japan

[73] Assignee: Komatsu Ltd., Tokyo, Japan

[21] Appl. No.: 09/304,022

[22] Filed: May 3, 1999

[30] Foreign Application Priority Data

May 1, 1998 [JP] Japan ..... 10-137448

[51] Int. Cl.[7] ..... F02M 33/04

[52] U.S. Cl. ..... 123/495

[58] Field of Search ..... 123/90.37, 495; 277/549, 560, 436

[56] References Cited

U.S. PATENT DOCUMENTS 5,259,351 11/1993 Rossignol ..... 123/506
5,682,861 11/1997 Stockner et al. ..... 123/495
5,899,136 5/1999 Tarr et al. ..... 123/495
5,951,022 9/1999 Gorman et al. ..... 277/560
6,047,970 4/2000 Friend et al. ..... 277/549

FOREIGN PATENT DOCUMENTS 2-145659 11/1990 Japan .

*Primary Examiner*—Thomas N. Moulis
*Attorney, Agent, or Firm*—Sidley & Austin

[57] ABSTRACT

The invention relates to a fuel injection device with an oil seal in which a fuel tank is not soiled by a lubricating oil and a lubricating oil consumption amount is a little. Accordingly, the fuel injection device is provided with a fuel returning annular groove (20) provided between an upper surface of the housing (13) and the pressure chamber (15) and on an inner periphery of the plunger hole (14) and further communicated with the fuel tank, and an oil seal (40) provided between the housing (13) and the plunger (11), thereby preventing a lubricating oil on the upper surface of the housing after lubricating the cam from entering into the fuel returning annular groove.

3 Claims, 3 Drawing Sheets

FUEL INJECTION DEVICE WITH OIL SEAL

FIELD OF THE INVENTION

The present invention relates to a fuel injection device for a diesel engine, and more particularly to a fuel injection device with an oil seal for a unit injector for a high pressure injection.

BACKGROUND ART

It is desired a unit injector for a high pressure injection of a diesel engine in order to improve an air pollution due to the diesel engine and reduce a fuel consumption. As an example, there has been suggested a structure described in Japanese Utility Model Unexamined Publication No. 2-145659.

FIG. 3 is a cross sectional view of a fuel injector 10*a* (a unit injector) for a high pressure injection suggested in the publication mentioned above. A plunger 11 is closely inserted in a plunger hole 14 provided in a housing 13 in such a manner as to protrude and freely slide in a vertical direction. The plunger 11 performs a vertical reciprocating motion by a return spring 12 and a drive force from a cam shaft (not shown). A pressure chamber 15 is formed in a lower end portion of the plunger 11. An annular groove 20 for returning a fuel (hereinafter, refer to as an annular groove 20) is provided on an inner peripheral surface of the plunger hole 14, and is connected to a fuel tank (not shown) via a narrow drain passage 21. A fuel injection nozzle 17 provided with a needle valve 16 in an inner portion thereof is mounted to a lower end portion of the housing 13, and the needle valve 16 is urged downward by a spring 18 so as to close a fuel injection port 19. The pressure chamber 15 and the fuel injection port 19 are communicated with each other by a passage 19*a*.

A poppet valve 30 having an annular conical valve seat 31 and driven by a solenoid and a solenoid stator 32 operating the poppet valve 30 are provided in a side portion of the housing 13. A fuel storage 33 is provided in a lower portion of the poppet valve 30, and the fuel storage 33 and a drain oil storage 34 provided in an upper portion of the annular conical valve seat 31 are communicated with each other by a drain fuel passage 35 connected to the fuel tank (not shown). Further, the fuel storage 33 is communicated with the fuel tank (not shown) by a housing inside supply passage 36 provided in the housing 13, and is always supplied a low pressure fuel by the fuel supply pump. Still further, the lower portion of the annular conical valve seat 31 and the pressure chamber 15 are communicated with each other by a fuel supply passage 37.

Next, an operation will be described below.

Since the low pressure fuel is always supplied to the housing inside supply passage 36 of the housing 13 from the fuel supply pump, the fuel storage 33 and the drain oil storage 34 are filled with the low pressure fuel. When operating the poppet valve 30 by the solenoid stator 32 so as to open the annular conical valve seat 31, the low pressure fuel in the drain oil storage 34 is supplied within the pressure chamber 15 via the fuel supply passage 37.

Next, when closing the annular conical valve seat 31 so as to drive the plunger 11 downward through a drive row assembly due to a rotation of a cam, the fuel within the pressure chamber 15 becomes a high pressure. Further, when a pressure of the fuel injection port 19 reaches a predetermined pressure, the needle valve 16 is pressed down so as to inject a fuel within a combustion chamber of an engine (not shown). When the fuel within the pressure chamber 15 becomes a high pressure, the fuel is lifted up with passing through a gap between the plunger 11 and the plunger hole 14, and the fuel is returned to the fuel tank (not shown) from the annular groove 20 through the drain passage 21, however, is not leaked outward. In this case, a contact surface between the drive row assembly and the plunger 11 is lubricated by a lubricating oil.

However, in accordance with the structure mentioned above, the lubricating oil supplied to a portion between the drive row assembly driven by the cam and the plunger 11 is attached to an outer diameter portion of the plunger 11, is leaked downward from the gap between the plunger hole 14 and the plunger 11 when the plunger 11 descends within the plunger hole 14, and is discharged to the fuel tank via the drain passage 21 after entering into the annular groove 20. Accordingly, there are problems that the fuel tank is soiled in black by the lubricating oil and a lubricating oil consumption amount is increased.

SUMMARY OF THE INVENTION

The present invention is made by paying attention to the problems mentioned above, and an object of the present invention is to provide a fuel injection device with an oil seal in which a fuel tank is not soiled by a lubricating oil and a lubricating oil consumption amount is a little.

In accordance with a first invention of the present invention, there is provided a fuel injection device with an oil seal in a fuel injection device for a unit injector of a diesel engine having a housing inserted to a cylinder head, a plunger protruding from an upper surface of the housing so as to closely inserted to a plunger hole pierced in the housing and slide in a vertical direction due to a force from a cam, a pressure chamber provided in a lower end portion of the plunger, a fuel injection nozzle provided below the pressure chamber and injecting a fuel fed in a pressurized state by the plunger from the pressure chamber into a cylinder chamber, wherein the improvement comprises a fuel returning annular groove provided between an upper surface of the housing and the pressure chamber and on an inner periphery of the plunger hole and further communicated with the fuel tank, and an oil seal provided between the housing and the plunger and preventing a lubricating oil on the upper surface of the housing after lubricating the cam from entering into the fuel returning annular groove.

In accordance with the structure mentioned above, the lubricating oil lubricating an engaging portion between the plunger and the cam or a poppet is stopped by the oil seal, and does not flow into a gap between the plunger hole in the housing and the plunger. Accordingly, the fuel tank is not soiled, and a lubricating oil consumption amount can be reduced.

In accordance with a second invention, there is provided a fuel injection device with an oil seal as recited in the first invention, wherein the oil seal comprises an annular spring seat arranged between the plunger and the upper surface of the housing and positioned below a spring which urges the plunger in an upper direction, and a lip portion provided in an inner diameter portion of the spring seat.

In accordance with the structure mentioned above, in addition to the operation and effect of the first invention, since the oil seal is positioned in a state of being held between the housing and the spring, it is possible to obtain a simple and compact structure.

In accordance with a third invention, there is provided a fuel injection device with an oil seal as recited in the first or second invention, wherein a lip portion of the oil seal is constituted by an elastic body, an upper lip surface of the lip portion is at an acute angle α with the plunger and a lower lip surface is at an obtuse angle β with the plunger.

In accordance with the structure mentioned above, the operations and effects of the first and second inventions can be securely achieved.

DETAILED DESCRIPTION OF THE PREFERRED EMBODIMENT

An embodiment of a fuel injection device with an oil seal in accordance with the present invention will be in detail described below with reference to FIGS. 1 and 2.

Figure 1:
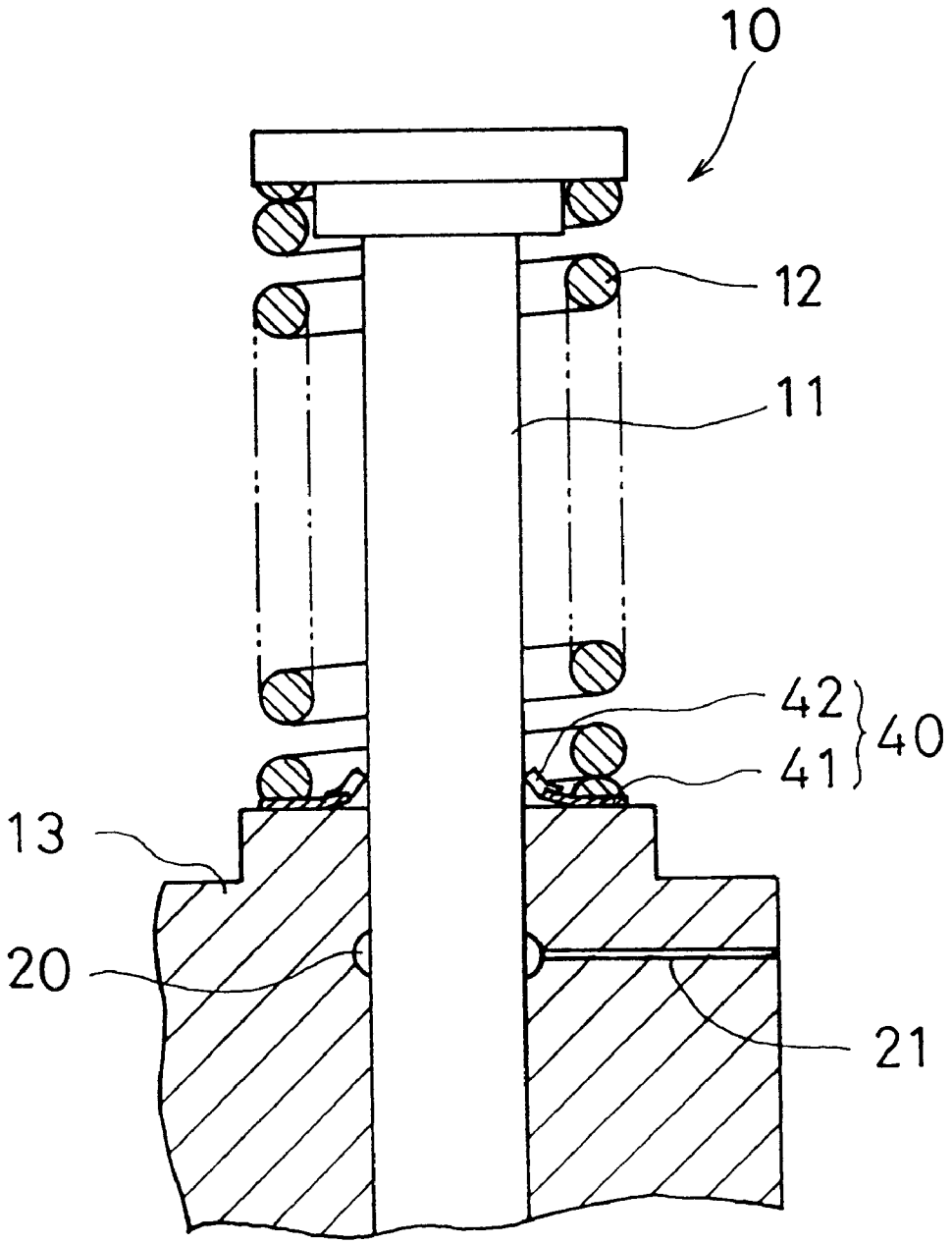
FIG. 1 is a cross sectional view of a detail of an upper portion of a high pressure injection unit injector in accordance with a fuel injection device with an oil seal of the present invention.
Figure 3:
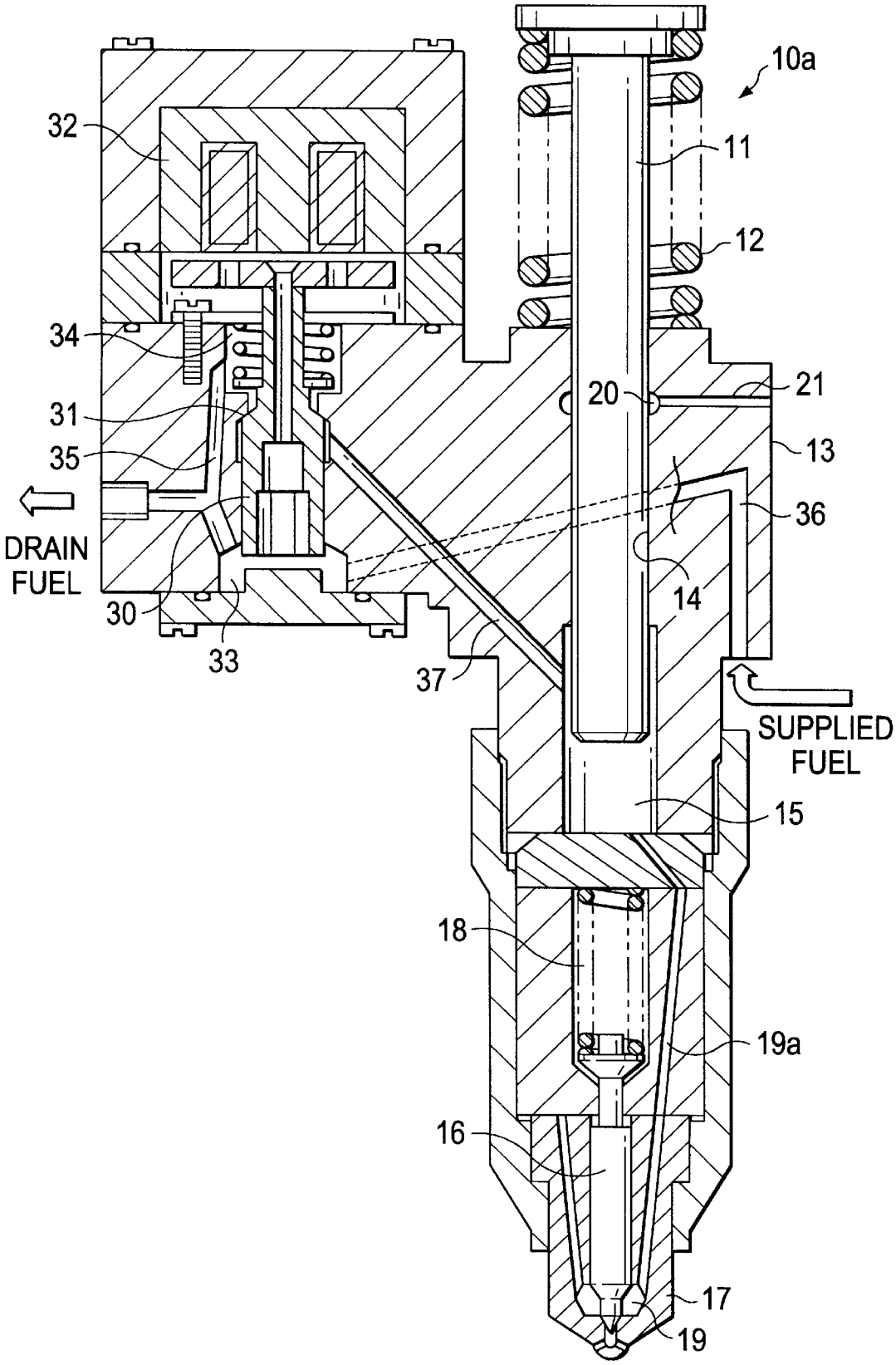
FIG. 3 (PRIOR ART)
FIG. 3 is a cross sectional view of a fuel injection device for a diesel engine in accordance with a conventional art.

FIG. 1 is a cross sectional view of an upper portion of a unit injector 10 in a fuel injection device with an oil seal. The same reference numerals are attached to the same elements as those in the conventional art shown in FIG. 3, and an explanation will be omitted.

An oil seal 40 is interposed between an upper surface of a housing 13 and a spring 12. The oil seal 40 comprises an annular spring seat 41 and a lip portion 42 mounted to an inner diameter portion of the spring seat 41. An inner diameter portion of the lip portion 42 is slidably brought into contact with an outer diameter portion of a plunger 11. Accordingly, the oil seal 40 is not shifted during a use, so that an improved seal performance can be secured. Since the structure is made in the manner mentioned above, the oil seal 40 can be mounted in a significantly compact manner and without necessity of an excessive space.

Figure 2:
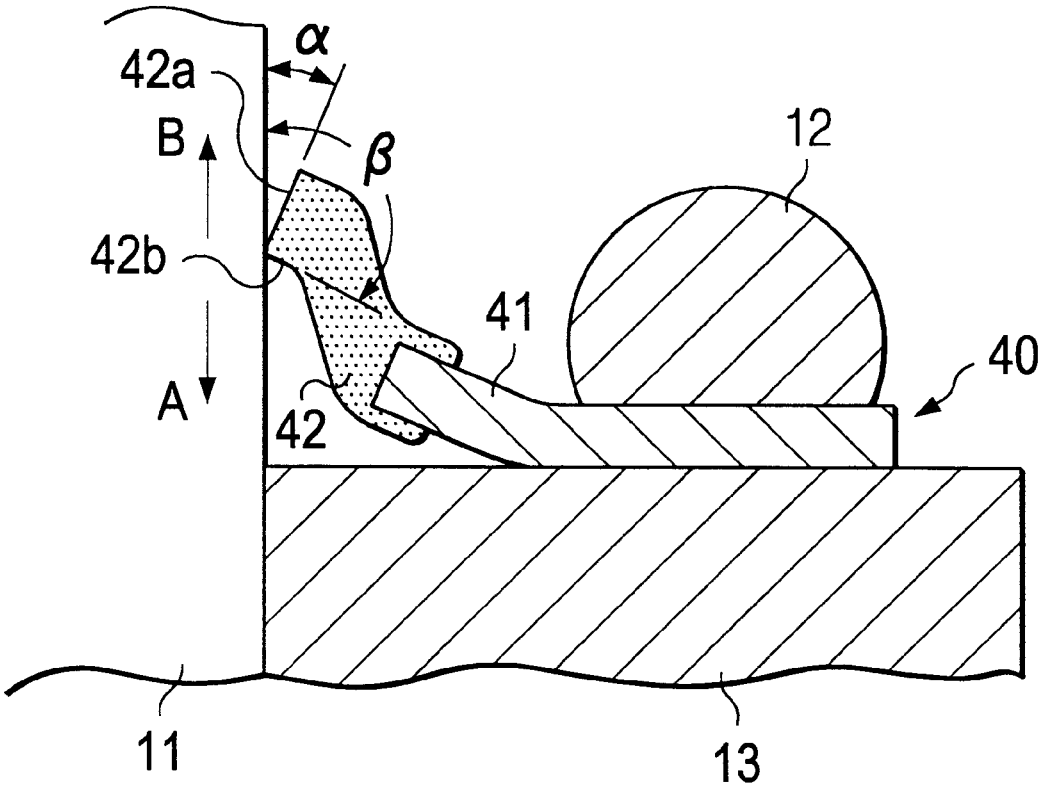
FIG. 2 is a cross sectional view of a detail of a part of the oil seal shown in FIG. 1.

FIG. 2 is a cross sectional view of a detail of a part of the oil seal 40. An elastic body mounted to the inner diameter portion of the spring seat 41, for example, an upper lip surface of an urethane rubber lip portion 42 forms an acute angle α with respect to the upper plunger 11. Further, a lower lip surface 42*b* of the lip portion 42 forms an obtuse angle β with respect to the upper plunger 11.

Accordingly, a necessarily minimum amount of lubricating oil leaks from the upper portion and flows downward (in a direction of an arrow A) when the plunger 11 descends, thereby lubricating a sliding surface between the plunger 11 and the plunger hole 14 of the housing 13 so as to prevent a seizure. On the contrary, a lubricating oil or a fuel disposed below the lower lip surface 42*b* can be prevented from leaking to an upper portion (in a direction of an arrow B) by the lip surface 42*b*.

Accordingly, the lubricating oil enters into the annular groove 20 and reaches the fuel tank, as a result, the fuel tank is not soiled and an amount of the lubricating oil is reduced. For example, a lubricating oil consumption amount has been conventionally 0.17% the fuel consumption amount, however, by using the fuel injection device with the oil seal in accordance with the present invention, the lubricating oil consumption amount can be reduced to 0.1% the fuel consumption amount.

What is claimed is:

1. A fuel injection device with an oil seal in a fuel injection device for a unit injector (10) of a diesel engine having a housing (13) inserted to a cylinder head, a plunger (11) protruding from an upper surface of the housing so as to closely inserted to a plunger hole (14) pierced in the housing (13) and slide in a vertical direction due to a force from a cam, a pressure chamber (15) provided in a lower end portion of the plunger, a fuel injection nozzle (17) provided below the pressure chamber and injecting a fuel fed in a pressurized state by said plunger from the pressure chamber into a cylinder chamber, wherein the improvement comprising:

a fuel returning annular groove (20) provided between an upper surface of said housing (13) and the pressure chamber (15) and on an inner periphery of the plunger hole (14) and further communicated with the fuel tank; and an oil seal (40) provided between said housing and said plunger (11) and preventing a lubricating oil on the upper surface of the housing after lubricating the cam from entering into the fuel returning annular groove.

2. A fuel injection device with an oil seal as claimed in claim 1, wherein said oil seal (40) comprising:

an annular spring seat (41) arranged between said plunger (11) and the upper surface of the housing (13) and positioned below a spring (12) which urges the plunger in an upper direction; and a lip portion (42) provided in an inner diameter portion of the spring seat.

3. A fuel injection device with an oil seal as claimed in claim 1 or 2, wherein a lip portion (42) of said oil seal (40) is constituted by an elastic body, an upper lip surface (42*a*) of the lip portion is at an acute angle α with said plunger (11) and a lower lip surface (42*b*) is at an obtuse angle β with said plunger.

* * * * *